US005357987A

United States Patent [19]

Schrepf

[11] Patent Number: 5,357,987

[45] Date of Patent: Oct. 25, 1994

[54] COSMETICS BRUSH WITH DISCONTINOUS BRISTLE FACE

[75] Inventor: Volker Schrepf, East Islip, N.Y.

[73] Assignee: Henlopen Manufacturing Co., Inc., Melville, N.Y.

[21] Appl. No.: 12,740

[22] Filed: Feb. 3, 1993

Related U.S. Application Data

[63] Continuation-in-part of Ser. No. 692,720, Apr. 29, 1991, abandoned.

[51] Int. Cl.[5] ..... A45D 40/26

[52] U.S. Cl. ..... 132/218; 132/320

[58] Field of Search ..... 132/216, 218, 320, 120; 401/126, 129; 15/DIG. 5, 206, 207, 106, 207.2

[56] References Cited

U.S. PATENT DOCUMENTS

| | | | |
|---|---|---|---|
| 1,659,707 | 2/1928 | Rudolph et al. | 15/206 |
| 2,465,396 | 3/1949 | Peterson et al. | 15/206 |
| 2,728,929 | 1/1956 | Bell | 15/206 X |
| 4,332,494 | 6/1982 | Kingsford | 132/218 X |
| 4,403,624 | 9/1983 | Montgomery | 132/218 |
| 4,600,328 | 7/1986 | Clements | 132/218 X |

FOREIGN PATENT DOCUMENTS

| | | |
|---|---|---|
| 2605505 | 4/1988 | France . |
| 2170996A | 8/1986 | United Kingdom . |
| 2198335A | 6/1988 | United Kingdom . |
| 2225225A | 5/1990 | United Kingdom . |

*Primary Examiner*—Gene Mancene
*Assistant Examiner*—Jeffrey A. Smith
*Attorney, Agent, or Firm*—Cooper & Dunham

[57] ABSTRACT

A brush for applying mascara or the like, having a bristle array with a discontinuous profile including two contiguous tandem portions, differing from each other in cross-section, for respectively performing different mascara-applying functions.

17 Claims, 2 Drawing Sheets

FIG.6
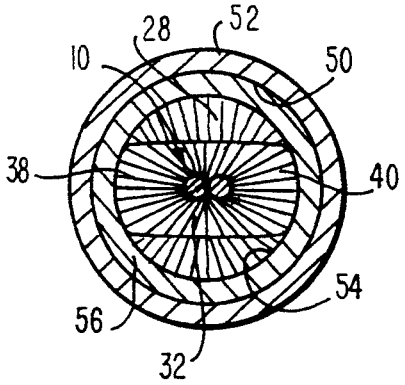
FIG.7
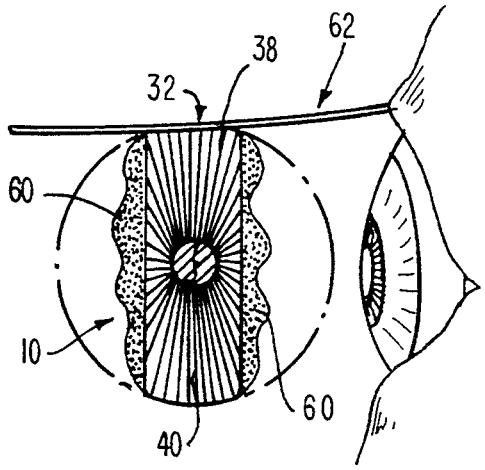
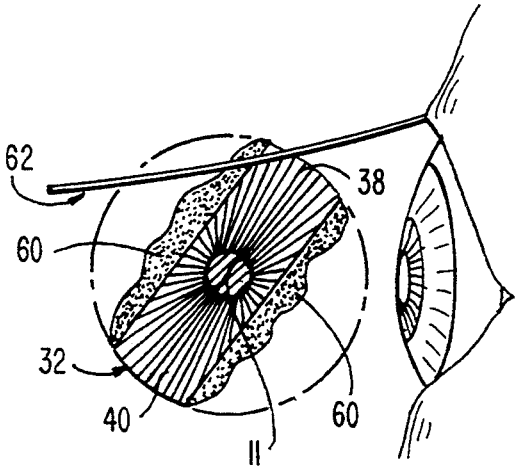
FIG.8
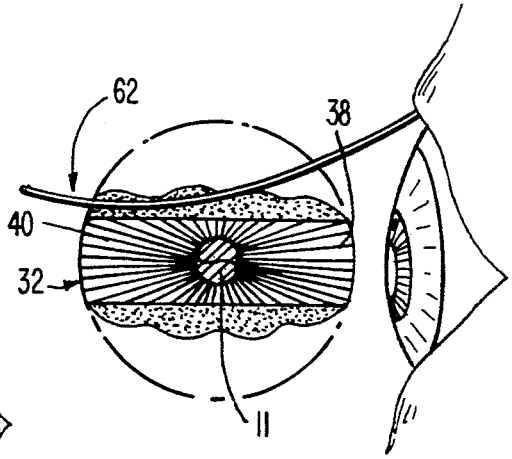
FIG.9
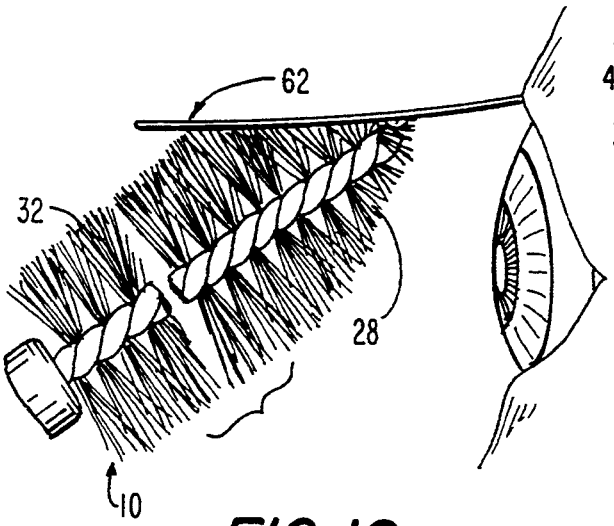
FIG.10

COSMETICS BRUSH WITH DISCONTINOUS BRISTLE FACE

CROSS REFERENCE TO RELATED APPLICATION

This application is a continuation-in-part of applicant's copending U.S. patent application Ser. No. 692,720, filed Apr. 29, 1991, and now abandoned.

BACKGROUND OF THE INVENTION

This invention relates to bristle brushes for applying cosmetics such as mascara or the like.

For purposes of illustration, the invention will be described as embodied in mascara brushes of the type having an axially elongated twisted wire core with a multiplicity of fibers such as bristles clamped at their midpoints in the core and extending radially outwardly therefrom to form a brush bristle array surrounding the core over a substantial portion of the length of the core, typically to the outer (distal) end of the core. The core is constituted of two runs of wire, which may be initially separate but are more usually opposed legs of a single U-shaped wire, twisted together into an axially rectilinear helix to hold the bristles between them. This combination of a twisted wire core and a radiating array of bristles clamped in the core provides a simple, low-cost and effective brush structure for uses exemplified by the application of mascara.

Such mascara brushes are well known and widely used in the cosmetics industry. Commonly, the proximal end of the brush is mounted within the threaded cap of a mascara container, so that the brush projects into the container when the cap is in container-closing position. Upon removal of the cap, the brush carries a quantity of mascara out of the container, and is manipulated to deliver and apply the mascara to the user's eyelashes, the cap serving as a handle for the brush.

In conventional mascara brushes having the described twisted-wire-and-bristle construction, the overall profile of the brush bristle array (such profile being the notional envelope defined by the bristle extremities) is ordinarily cylindrical and/or smoothly tapering, with progressively shorter bristles, toward the distal end of the brush. The bristles within the profile may be arranged in discrete though closely spaced helical rows corresponding to the helical turns of the wire core, or they may be distributed substantially uniformly. In either case, any given brush has essentially only a single set of applicator characteristics (shape, dimensions, bristle stiffness, etc.). The application of mascara, however, involves diverse functions and operations, including pickup, transport and deposit of the mascara; combing of the lashes; and even distribution of the applied mascara. The applicator characteristics of a given conventional brush do not perform all these various functions and operations equally well.

It has heretofore been proposed to provide two implements, such as a brush and a comb, for separately performing the diverse functions involved in applying mascara. The provision of two implements adds to cost and detracts from convenience of use; furthermore, as it is usually not feasible to enclose more than one implement in a mascara container, one of the implements must be left exposed (when not in use) to contamination outside the container.

SUMMARY OF THE INVENTION

An object of the present invention is to provide a bristle brush, for applying cosmetic material such as mascara or the like, combining within a single structure diverse applicator characteristics respectively suited to the performance of specifically different functions in the application of the cosmetic material, and capable of being enclosed within a container of the material when not in use.

Another, more specific object is to provide such a brush having portions respectively adapted for delivering mascara to a user's lashes and combing delivered mascara through the lashes.

A further object is to provide such a brush enabling the user to determine selectively the amount of mascara applied, by manipulation at the point of application, and then to comb the mascara through the lashes.

To these and other ends, the present invention broadly contemplates the provision of a mascara brush comprising an elongated wire core having two runs of wire helically twisted together about a rectilinear axis to form a succession of turns including two contiguous sets of plural successive turns respectively disposed distally and proximally along the brush, and an array of bristles projecting outwardly around the two sets of turns, the array including, in each turn of each of the sets, a plurality of bristles each clamped between the runs of wire and having opposed free tips extending radially therefrom, the array comprising two contiguous portions, respectively disposed distally and proximally along the brush and respectively consisting of the bristles clamped in the two sets of turns, the tips of the bristles of each of the portions defining a notional envelope or bristle array profile, the two portions respectively having bristle tips disposed to define envelopes with cross-sections differing from each other such that there is a discontinuity between the envelopes of the two portions, for respectively performing different mascara-applying functions. Typically, the proximal end of the core engages an end of a stem having an opposite end secured within a mascara container cap.

Specifically, the invention may be embodied in a brush in which one of the bristle array portions is a portion for delivering mascara from a container to a user's lashes and the other is a portion for combing delivered mascara through the lashes. Preferably, the envelope of the delivering portion is offset inwardly toward the core along its length, on at least one side of the core, with respect to the envelope of the combing portion. The combing portion may be the distal portion of the array, and at the discontinuity between the two portions its envelope preferably has an abrupt edge extending transversely of the core at least on one side of the core. As yet another feature of convenience and advantage, the envelope of the delivering portion may have at least one longitudinally extending edge.

In an additional aspect, the invention contemplates the combination, with a mascara container having an opening, of a brush having features as described above for withdrawing mascara from the container through the opening and delivering it to and combing it through a user's lashes, the container including a wiper mounted in the opening and defining an orifice for wiping mascara from the brush as the brush is withdrawn through the opening, and the aforementioned two (delivering and combing) portions of the brush respectively having bristle tips disposed to define envelopes so shaped and dimensioned that the wiper removes less mascara from the delivering portion than from the combing portion. Preferably, the envelopes of the two portions are so shaped and dimensioned that the wiper engages the combing portion with full wiping efficacy around the entire cross-sectional periphery thereof at least adjacent the discontinuity between the portions, and does not uniformly engage the entire cross-sectional periphery of the delivering portion, such that the amount of mascara transported from the container by the delivering portion varies from point to point around the delivering portion periphery.

Configurations currently preferred for the brushes of the invention include those in which the envelope of one of the two bristle array portions is radially symmetrical about the axis and the envelope of the other of the portions is radially asymmetrical about that axis.

In particular embodiments of the invention, a first one of the portions is a generally arrowhead-shaped distal portion of the bristle array, the first portion having a proximal end and having a maximum cross-sectional area at that proximal end and tapering therefrom toward the distal end of the wire core; and a second one of the portions, contiguous to and disposed proximally of the first portion, has a uniform cross-section smaller in at least one dimension than the cross-section of the proximal end area of the first portion, such that there is a discontinuity of bristle array profile between the first and second portions. The bristles of the second portion may be cut to provide a profile having an elongated rectangular cross section; in such case, the proximal end of the first portion may have a cross-sectional diameter, and the rectangular cross section may have a long dimension, such that the long dimension of the rectangular cross-section is substantially equal to the cross-sectional diameter of the proximal end of the first portion.

In another embodiment, the bristles of the second portion are cut to provide a cylindrical profile of small cross-sectional diameter coaxial with the wire core, and the bristles of the first portion are cut, in progressively varying lengths, such that the first portion has a profile eccentric to the wire core with a maximum cross-sectional diameter substantially larger than the cross-sectional diameter of the second portion.

Further features and advantages of the invention will be apparent from the detailed description hereinbelow set forth, together with the accompanying drawings.

BRIEF DESCRIPTION OF THE DRAWINGS

FIG. 6 is a schematic view of the brush of FIG. 1 in operative relation with a wiper of a mascara container;

FIGS. 7, 8 and 9 are schematic views illustrating the use of the brush of FIG. 1 for respectively delivering or applying minimal, medium, and maximum loads of mascara to a user's lashes; and FIG. 10 is a schematic view illustrating the use of the brush of FIG. 1 for combing applied mascara through the lashes.

DETAILED DESCRIPTION OF THE PREFERRED EMBODIMENT

Figure 1:
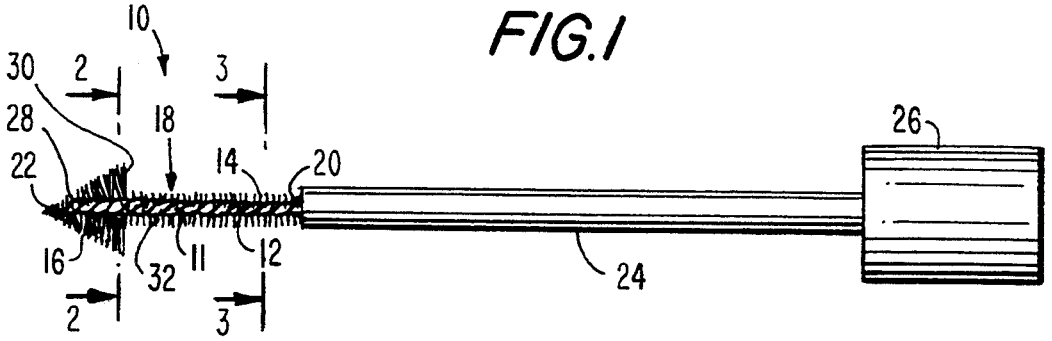
FIG. 1 is a side view of a mascara brush embodying the present invention in a particular form.

Referring to the drawings, in which like numerals designate like elements throughout the several views, each of the two embodiments therein shown includes a generally conventional brush structure 10 comprising an elongated, axially rectilinear core 11 constituted of two helically twisted-together runs 12, 14 of metal wire, and a multi-apparent plicity of fibers or bristles 16, each clamped between the wires 12, 14 and having opposed free tips extending radially outwardly therefrom to form a brush bristle array 18 surrounding the core over a substantial portion of the length of the core. The manufacture and arrangement of such structures are well known in the art, and need not be further described. It will be understood that the wire runs 12 and 14 may be separate lengths of wire, or opposed legs of a single initially U-shaped wire. The core 11 has a proximal end 20, and a distal end 22 to which the bristle array extends; end 20 is mounted in a stem 24 extending from (and secured within) an internally threaded container cap 26.

As thus far described, the brush structure 10 may be generally conventional. A conventional brush, however, would have a continuous, smoothly cylindrical and/or tapering bristle array profile. In accordance with the present invention, in the embodiment of FIGS. 1–3, the bristles in the distal portion 28 of the array 18 are trimmed to a conical or arrowhead shape, coaxial with the core 11 and tapering distally, such that the maximum cross-sectional area (region of longest bristles) of portion 28 is at the proximal end 30 of that portion. As best seen in FIG. 2, the cross section of end 30 (the base of the arrowhead) is circular. The bristles of the remaining, proximal portion 32 of the array 18 are trimmed to a profile of elongated rectangular cross section (FIG. 3) with a short cross-sectional dimension designated 34 and a long cross-sectional dimension designated 36. Dimension 36 is about equal to, and dimension 34 is substantially shorter than, the cross-sectional diameter of the arrowhead base 30.

The arrowhead or conical tip portion 28 and the rectangular-cross-section portion 32 of the bristle array are disposed in contiguous tandem relation along the wire core 11. Thus, on opposed sides of the brush (where the shortest cut bristles of portion 32 are located), there is an abrupt discontinuity of bristle array profile at the juncture of the proximal end (arrowhead base) 30 of portion 28 with the distal end of portion 32.

Figure 2:
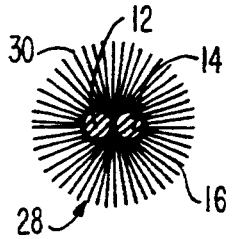
FIG. 2 is a view taken on line 2—2 of FIG. 1.
Figure 3:
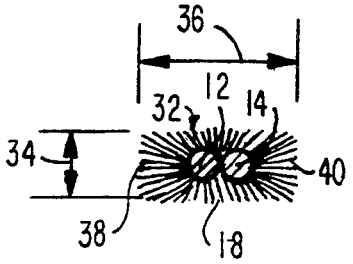
FIG. 3 is a view taken on line 3—3 of FIG. 1.

That is to say, in the brush of FIGS. 1–3 the runs of wire 12, 14 are helically twisted together about a rectilinear axis to form a succession of turns which may usefully be considered (for the purpose of describing the invention) as including two (distal and proximal) contiguous sets of turns, and the bristle array 18 comprises two contiguous (distal and proximal) portions 28 and 32 respectively consisting of the bristles clamped in the two sets of turns. The tips of the bristles of each portion define a notional envelope or profile, this envelope being the simplest (smallest area) notional three-dimensional surface containing the bristle tips; thus, the envelope of portion 28 in FIGS. 1–3 is a notional conical surface, and that of portion 32 is a notional rectangular-solid surface, regardless of whether the bristle tips of each portion are uniformly distributed throughout such surface or are aligned in more or less spaced-apart helices corresponding to the turns of the core wire runs.

Accordingly, the cross-sections of the envelopes (in planes perpendicular to the axis of the core) differ from each other (one being circular, the other rectangular) so as to create the discontinuity between the envelopes of the two portions, i.e., as viewed in the plane of FIG. 1.

The complex, discontinuous profile of the bristle array 18 with the "sharp" profile edges formed in the portion 32 of rectangular cross section and at the base 30 of the conical tip portion 28, as well as the progressively shorter bristles terminating in the apex of the cone at the core distal end 22, provide the user with a diversity of bristle lengths, flexibility, and profile shapes and dimensions to perform the variety of different operations involved in the application of mascara. Specifically, and as further explained below, the portion 32 performs the function of delivering mascara from a container thereof to a user's lashes (and applying the mascara to the lashes) while the portion 28 performs the function of combing the delivered and applied mascara through the lashes.

Other geometric cross sections can also perform the several types of applicator action afforded by the invention. For example, the arrowhead-shaped portion 28 can be bullet-shaped or hemispherical rather than conical.

Figure 4:
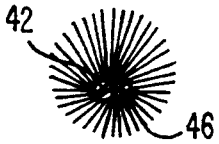
FIG. 4 is an enlarged fragmentary side view of another embodiment of the invention.
Figure 5:
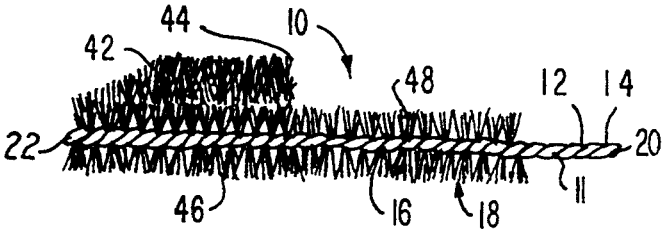
FIG. 5 is an end view of the embodiment of FIG. 4.

The embodiment of FIGS. 4–5 has a distal portion 42 of the bristle array tapering toward the distal end 22 of the wire core 11 and of circular cross section throughout, achieving its greatest cross-sectional area at its proximal end or geometric base 44. The profile of portion 42, however, is eccentric to the axis of core 11; thus, on one side 46 of the brush, the bristles are cut to a uniform short length throughout the axial extent of portion 42, becoming progressively longer toward the other side of the brush. The proximal portion 48 of the bristle array (contiguous to, and disposed in tandem with, portion 42) is cut to a cylindrical profile of very short bristles about equal in length to the bristles on the short side 46 of portion 42. Except at side 46, therefore, there is an abrupt discontinuity of profile between the base 44 of portion 42 and the distal end of portion 48.

In this structure, the enlarged, tapered distal portion 42 of the bristle array and its base 44 perform functions similar to those of the arrowhead tip portion 28 of FIGS. 1–3. Preferably, the bristles used in the embodiment of FIG. 2 are hollow fibers, to provide substantial uniformity of bristle distribution (as opposed to discrete helical rows) especially in the longer-bristle portions of the array.

Each of the described brushes may be made by preparing a brush structure constituted of bristles of initially substantially equal length clamped between and extending radially from helically twisted wires 12, 14, and thereafter cutting the bristles to achieve the desired profile. The brush of the invention, mounted as shown in a container cap, may be housed in a container of mascara or the like when not in use, in the same manner as a conventional mascara brush, being thereby protected from contamination. It provides, in a single and easily manipulable brush implement, a diversity of applicator characteristics enabling satisfactory performance of varied cosmetic-applying functions.

The use of the brush of the invention, and its combination with a mascara container, will now be readily apparent by reference to FIGS. 6–10, which illustrate the use of the specific embodiment of FIGS. 1–3.

FIG. 6 is a view looking down into the mouth or opening 50 of a generally conventional mascara container 52, showing (in cross section) the brush 10 of FIGS. 1–3 being withdrawn from the container through the orifice 54 of a conventional resiliently flexible wiper 56 mounted within the container opening. When the brush is fully inserted in the container, the bristles of both its portions 28 and 32 are immersed in the contained mascara, and thus become loaded with the mascara. As the brush is withdrawn from the container, the wiper 56 acts to remove excess mascara from the brush. The wiper orifice, however, is generally circular, and as brush portion 32 passes through it, the operative diameter of this orifice is greater than the shorter cross-sectional dimension 34 (FIG. 3) of portion 32; consequently, as illustrated, it wipes mascara effectively from the long-bristle sides 38 and 40 of portion 32, but removes little or no mascara from the short-bristle sides of that brush portion. Owing to the configuration and dimensions of the brush portion 28, effective wiping action occurs entirely around the periphery of that portion during passage through the wiper orifice.

When the brush has been completely withdrawn from the container for transport of mascara to a user's lashes, as shown in FIGS. 7–9, the loading of mascara on the brush portion 32 varies from side to side around its periphery. The wide (short-bristle) sides of portion 32 bear a heavy load 60 of mascara, because of the relative or total absence of wiping action on those sides, while the narrow (long-bristle) sides bear a minimum loading of mascara, having been effectively wiped. Thus, the user can selectively apply a minimum (FIG. 7), medium (FIG. 8) or maximum (FIG. 9) loading of mascara to her lashes 62, by varying the angular orientation of the lightly and heavily loaded sides of portion 32 (about the axis of the brush core 11) relative to the lashes so as to effect minimum (FIG. 7), partial (FIG. 8) or maximum (FIG. 9) contact of the lashes with the heavy load 60 on the wide sides of the brush portion. The differential loading of portion 32 from point to point around its periphery also enables the user to selectively apply different loadings of mascara to different portions of the eyelashes.

When delivery/application of the mascara from portion 32 to the lashes 62 is complete, the user employs the distal portion 28 of the brush to comb the delivered mascara through the lashes (FIG. 10). The long bristles of the latter portion provide effective combing action, and as portion 28 is effectively wiped all around its periphery, the combing operation does not overload the lashes with mascara.

It is to be understood that the invention is not limited to the features and embodiments hereinabove specifically set forth but may be carried out in other ways without departure from its spirit.

What is claimed is:

1. A mascara brush comprising (a) an elongated wire core having two runs of wire helically twisted together about a rectilinear axis forming a succession of turns including two contiguous sets of turns, each of said two sets consisting of plural successive turns, respectively disposed distally and proximally along said brush, and (b) an array of bristles projecting outwardly around said two sets of turns, said array including, in each turn of each of said sets, a plurality of bristles each clamped between the runs of wire and having opposed free tips extending radially therefrom, said array comprising two contiguous portions, respectively disposed distally and proximally along said core and respectively consisting of the bristles clamped in one of said two sets of turns and the bristles clamped in the other of said two sets of turns, the tips of the bristles of each of said portions defining a notional envelope, (c) said two portions respectively having bristle tips disposed to define envelopes with cross-sections differing from each other such that there is a discontinuity between the envelopes of said two portions, for respectively performing different mascara-applying functions.

2. A mascara brush as defined in claim 1, wherein one of said portions is a portion for delivering mascara from a container to a user's lashes and the other is a portion for combing delivered mascara through the lashes.

3. A mascara brush as defined in claim 2, wherein the envelope of one of said two portions is offset toward the core along the length of the last-mentioned envelope, on at least one side of the core, with respect to the envelope of said other portion.

4. A mascara brush as defined in claim 3, wherein the other of said two portions is the distal portion of the array.

5. A mascara brush as defined in claim 3, wherein the envelope of the other of said two portions has, at said discontinuity, an abrupt edge extending transversely of the core at least on said one side of the core.

6. A mascara brush as defined in claim 3, wherein the envelope of said one of said two portions has at least one longitudinally extending edge.

7. A mascara brush as defined in claim 1, wherein the envelope of one of said two portions is radially symmetrical about said axis and the envelope of the other of said portions is radially asymmetrical about said axis.

8. A mascara brush as defined in claim 1, wherein, on at least one side of the core adjacent the discontinuity, the bristles held by plural turns of one of said two sets project further from the core than the bristles held by plural turns of the other of said sets.

9. A mascara brush as defined in claim 1, wherein, on different sides of the core, the tips of the bristles of one of said portions are spaced at different distances from the core.

10. The combination, with a mascara container having an opening, of a brush for withdrawing mascara from the container through the opening and delivering it to and combing it through a user's lashes, said container including a wiper mounted in the opening and defining an orifice for wiping mascara from the brush as the brush is withdrawn through the opening, said brush comprising:

(a) an elongated wire core having two runs of wire helically twisted together about a rectilinear axis forming a succession of turns including two contiguous sets of turns, each of said two sets consisting of plural successive turns, respectively disposed distally and proximally along said brush, and (b) an array of bristles projecting outwardly around said two sets of turns, said array including, in each turn of each of said sets, a plurality of bristles each clamped between the runs of wire and having opposed free tips extending radially therefrom, said array comprising two contiguous portions, respectively disposed distally and proximally along said core and respectively consisting of the bristles clamped in one of said two sets of turns and the bristles clamped in the other of said two sets of turns, the tips of the bristles of each of said portions defining a notional envelope, (c) said two portions respectively having bristle tips disposed to define envelopes with cross-sections differing from each other such that there is a discontinuity between the envelopes of said two portions, for respectively delivering mascara to the lashes and combing delivered mascara therethrough, (d) wherein the envelopes of said two portions are respectively so shaped and dimensioned that the wiper removes less mascara from the delivering portion than from the combing portion.

11. The combination defined in claim 10, wherein the envelopes of said two portions are so shaped and dimensioned that the wiper engages the combing portion with full wiping efficacy around the entire cross-sectional periphery thereof at least adjacent said discontinuity, and does not uniformly engage the entire cross-sectional periphery of the delivering portion, such that the amount of mascara transported from the container by the delivering portion varies from point to point around the delivering portion periphery.

12. A brush for applying cosmetic material, comprising an axially elongated twisted wire core having a proximal end and a distal end, and a multiplicity of bristles clamped in the core and extending radially therefrom constituting a brush bristle array projecting outwardly around the core over a substantial part of the length of the core, wherein the bristle array has a discontinuous profile including at least two axially extended portions disposed in contiguous tandem relation to each other along the wire core and respectively having cross-sections differing from each other such that there is a discontinuity of bristle array profile between said two portions, for performing different cosmetic-applying functions; wherein a first one of said portions is a generally arrowhead-shaped distal portion of the bristle array, said first portion having a proximal end and having a maximum cross-sectional area at said proximal end and tapering therefrom toward the distal end of the wire core; and wherein a second one of said portions, contiguous to and disposed proximally of said first portion, has a uniform cross-section smaller in at least one dimension than the cross-section of the proximal end area of said first portion, such that there is a discontinuity of bristle array profile between said first and second portions.

13. A brush as defined in claim 12, wherein the bristles of said second portion are cut providing a profile having an elongated rectangular cross section.

14. A brush as defined in claim 13, wherein said proximal end of said first portion has a cross-sectional diameter, and said rectangular cross section has a long dimension, such that said long dimension of said rectangular cross-section is substantially equal to the cross-sectional diameter of the proximal end of said first portion.

15. A brush as defined in claim 12, wherein the bristles of said second portion are cut providing a cylindrical profile of small cross-sectional diameter coaxial with the wire core, and the bristles of said first portion are cut, in progressively varying lengths, such that said first portion has a profile eccentric to the wire core with a maximum cross-sectional diameter substantially larger than the cross-sectional diameter of said second portion.

16. A brush as defined in claim 12, wherein said proximal end of said first portion has a relatively sharp edge and wherein said second portion has longitudinal edges.

17. A brush as defined in claim 12, wherein said proximal end of said core engages an end of a stem having an opposite end secured within a cosmetics container cap.

* * * * *